US005713040A

United States Patent [19]

Lee

[11] Patent Number: 5,713,040

[45] Date of Patent: Jan. 27, 1998

[54] MONITOR-MODE CONTROL CIRCUIT AND METHOD THEREOF

[75] Inventor: Ji Young Lee, Seoul, Rep. of Korea

[73] Assignee: Samsung Electronics Co., Ltd., Suwon, Rep. of Korea

[21] Appl. No.: 639,432

[22] Filed: Apr. 29, 1996

Related U.S. Application Data

[63] Continuation of Ser. No. 252,661, Jun. 1, 1994, abandoned.

[30] Foreign Application Priority Data

Dec. 4, 1993 [KR] Rep. of Korea ..... 93-26485

[51] Int. Cl.[6] ..... G09G 5/00

[52] U.S. Cl. ..... 395/800; 375/238; 345/213; 345/214; 345/132; 345/133; 345/134; 348/469; 348/536; 348/554

[58] Field of Search ..... 395/800, 358, 395/132, 127, 133, 558; 345/213, 500, 132–134, 214; 375/238; 348/469, 536, 554

[56] References Cited

U.S. PATENT DOCUMENTS

| | | | |
|---|---|---|---|
| 4,168,508 | 9/1979 | Gilbert | 358/82 |
| 4,306,270 | 12/1981 | Miller et al. | 361/81 |
| 4,727,362 | 2/1988 | Rackley et al. | 340/703 |
| 5,027,212 | 6/1991 | Marlton et al. | 358/183 |
| 5,161,022 | 11/1992 | Ichimura et al. | 358/190 |
| 5,237,223 | 8/1993 | Song | 327/39 |
| 5,285,197 | 2/1994 | Schmidt et al. | 345/213 |
| 5,367,266 | 11/1994 | Kang | 327/47 |
| 5,384,642 | 1/1995 | Sim | 358/336 |
| 5,394,171 | 2/1995 | Rabii | 345/213 |
| 5,473,666 | 12/1995 | Szczebak, Jr. et al. | 379/3 |
| 5,493,317 | 2/1996 | Kim | 345/213 |

FOREIGN PATENT DOCUMENTS 5-143041 7/1993 Japan .

OTHER PUBLICATIONS

Motorola Inc "MC68HC705H2 HCMOS Microcontroller Unit", 1992, Oct. 1 to Oct. 8.

Perkins et al., "Multimode High . . . Chip Set," IEEE, 1990, pp. 458–466.

*Primary Examiner*—Tod R. Swann
*Assistant Examiner*—Denise Tran
*Attorney, Agent, or Firm*—Ladas & Parry

[57] ABSTRACT

A monitor-mode control circuit and method thereof determines a video mode by detecting horizontal and vertical sync frequencies and the polarities of the sync frequencies received from a video card, varies an external resistance value connected to a predetermined port of a microprocessor in accordance with the determined video mode to output a voltage for controlling the picture status of the monitor, in which a program of the microprocessor is changed by a demand of a buyer without changing the hardware to easily correspond to any specification required by the buyer unrestricted by the specification, an external resistance value connected to the predetermined port of the microprocessor at a high or low state is varied to adjust and output voltages of a horizontal size, a vertical size, a horizontal position, a vertical position and a side pin/barrel corresponding to the determined video mode, and a voltage of an oscillating frequency for correcting the synchronization of a picture is output by a pulse width modulation method, so that manufacturing cost is reduced without using a D/A converter of an EEPROM to heighten the competitive power of the products.

1 Claim, 6 Drawing Sheets

START
401
H>40KHZ ?
N
402
19 PORT RESET
Y
403
V>70HZ ?
N
404
24 PORT RESET
Y
405
MODE = # 1 ?
Y
406
1,6,12,16,20 PORT RESET
N
407
MODE = # 2 ?
Y
408
2,6,14,16,20 PORT RESET
N
409
MODE = # 3 ?
Y
410
3,6,15,16,20 PORT RESET
N
411
MODE = # 4 ?
Y
412
4,6,12,16,22 PORT RESET
N
413
MODE = # 5 ?
Y
414
5,6,12,16,22 PORT RESET
N
415
MODE = # 6 ?
Y
416
4,6,14,16,22 PORT RESET
N
417
MODE = # 7 ?
Y
418
2,6,14,16,22 PORT RESET
N
419
MODE = # 8 ?
Y
420
1,6,16,20,41 PORT RESET
N
421
MODE = # 9 ?
Y
422
2,6,12,16,23 PORT RESET
C
RETURN

MONITOR-MODE CONTROL CIRCUIT AND METHOD THEREOF

This application is a continuation of application Ser. No. 08/252,661 filed on Jun. 1, 1994 now abandoned.

BACKGROUND OF THE INVENTION

1. Field of the Invention

The present invention relates to a monitor-mode control circuit and method thereof, and more particularly to a monitor-mode control circuit and method thereof, wherein horizontal and vertical sync frequencies and sync frequency polarities received from a video card are detected to determine a video mode, a voltage for controlling picture status of a monitor is varied in accordance with the determined video mode, and a voltage of an oscillating frequency is varied by a pulse width modulation method (hereinafter referred to as "PWM") to easily correspond to any specific demands with respect to the video mode.

2. Description of the Prior Art

In order to produce characters and graphics on a monitor in a computer, a video card is required and plays an important role as such in displaying colors of a picture.

Here, the video card respectively has inherent frequency bands of a vertical sync signal and a horizontal sync signal for video modes, and different polarities of sync signals in accordance with the modes.

In the monitor for displaying video data supplied from the video card, a horizontal oscillating frequency (H-OSC), a vertical oscillating frequency (V-OSC), a horizontal size (H-SIZE), a vertical size (V-SIZE), etc. should be adjusted according to the video mode of the video card.

For this operation, Korean patent application No. 91-7092 related to an automatic control circuit of a multi-mode monitor and method thereof has been filed on May 2, 1991, by this applicant, in which a video mode is automatically determined by using a microprocessor and the picture state of the monitor is automatically adjusted in accordance with the determined video mode.

However, the above application utilizes an electrically-erasable programmable ROM(EEPROM) to store and read out display data corresponding to the determined video mode, and a digital-to-analog converter to convert the read-out data into control data for controlling the picture status, thereby raising manufacturing costs.

Meanwhile, application specification ICs (ASICs) for discriminating a video mode in view of a buyer's demand and adjusting the picture state of the monitor in accordance with the determined video mode are employed, which are, however, unsuitable for a specific demand since the limited number of video modes restricts the specification. In addition to this restriction, once fixed, the ASIC is difficult to be modified to thus impede the general use thereof.

SUMMARY OF THE INVENTION

The present invention is devised to solve the above-described problems. Accordingly, it is an object of the present invention to provide a monitor-mode control circuit and method thereof, wherein horizontal and vertical sync frequencies and polarities are detected by a microprocessor to determine a video mode, and a voltage is varied by adjusting an external resistance value connected to the microprocessor in accordance with the determined video mode, and picture-control data of a monitor matching with the determined video mode is output to easily correspond to any specification demand. Also, a D/A converter and an EEPROM are not employed to reduce manufacturing cost.

To achieve the above object of the present invention, a monitor-mode control circuit includes a microprocessor which determines a video mode by detecting horizontal and vertical sync frequencies and the polarities thereof received from a video card, and produces a high or low signal to a predetermined port, and a predetermined number of resistors respectively connected to ports of the microprocessor for producing picture-control mode voltages corresponding to the video mode determined by the high or low signals supplied to the ports.

To achieve the above object of the present invention, a monitor-mode control method includes the steps of:

- detecting horizontal and vertical sync frequencies and polarities received from a video card;
- determining a video mode of the video card, using the detected horizontal and vertical sync frequencies and polarities;
- producing an oscillating voltage in accordance with corresponding horizontal and vertical sync frequencies through a pulse width modulation method; and
- producing a high or low signal, simultaneously while producing the oscillating voltage, by selecting respective ports of a picture control means in accordance with the determined video mode, and adjusting a voltage of the picture control means.

BRIEF DESCRIPTION OF THE DRAWINGS

The above objects and other advantages of the present invention will become more apparent by describing in detail preferred embodiments thereof with reference to the attached drawings, in which.

DETAILED DESCRIPTION OF THE PREFERRED EMBODIMENTS

Figure 1:
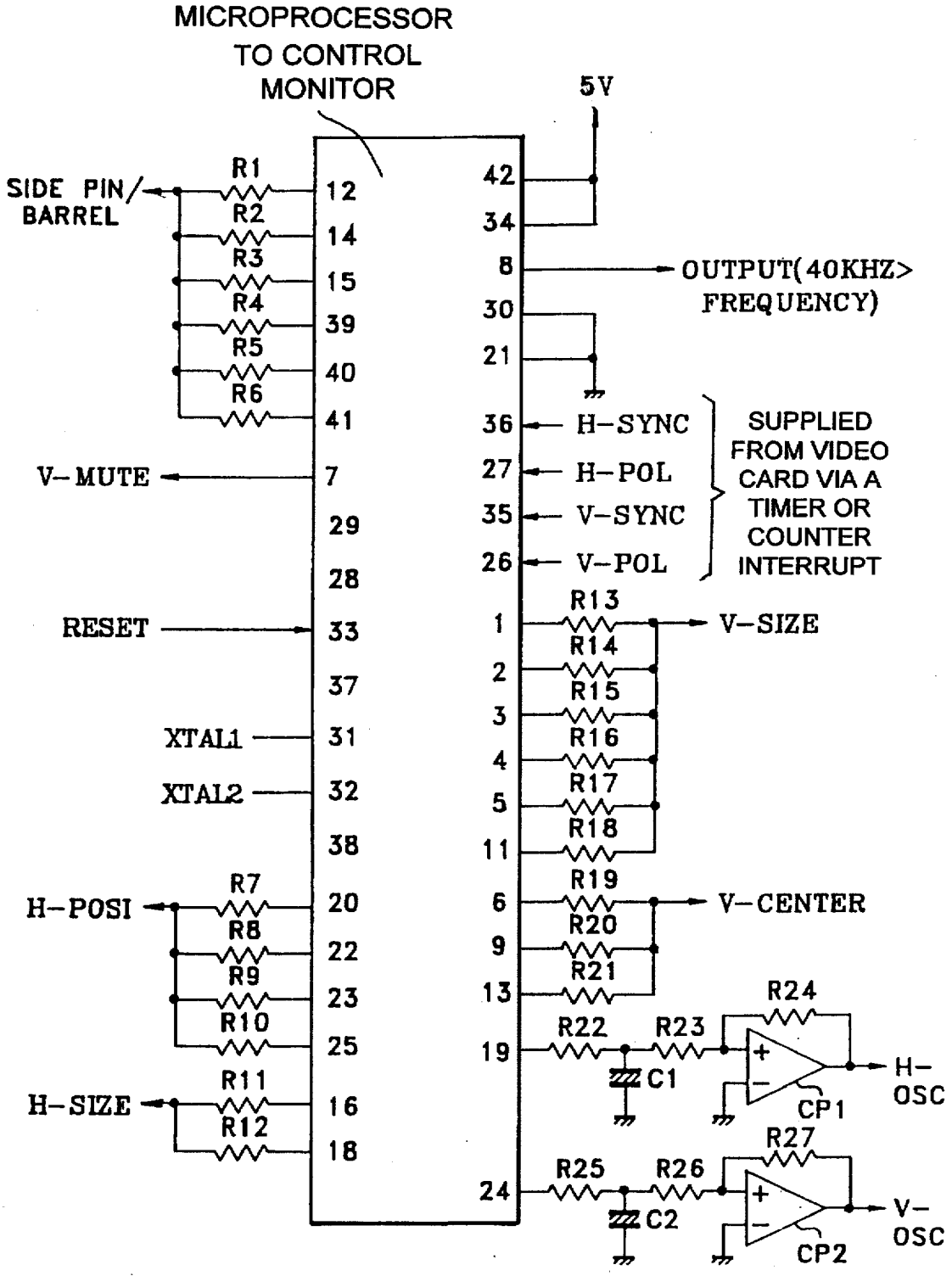
FIG. 1 is a circuit diagram showing a monitor-mode control circuit according to the present invention.

Referring to FIG. 1, a monitor-mode control circuit according to the present invention includes a microprocessor, and resistors R1–R27 respectively connected to predetermined ports of the microprocessor. Here, TMP47C200RN (ROM 2 K Byte, Toshiba Co., LTD.) is taken as an example of the microprocessor. A side pin/barrel terminal is respectively connected via the resistors R1–R6 connected to the ports 12, 14, 15, 39, 40 and 41 of the microprocessor. A horizontal position terminal H-POSI for shifting a picture left and right is connected to the ports 20, 22, 23 and 25 via the resistors R7–R10. A horizontal size terminal H-SIZE for adjusting the horizontal size of the picture is connected to the ports 16 and 18 via the resistors R11 and R12, respectively. A vertical size terminal V-SIZE for adjusting the vertical size of the picture is connected to the ports 1, 2, 3, 4, 5 and 11 via the resistors R13–R18. A vertical position terminal V-CENTER for shifting the picture up and down is connected to the ports 6, 9 and 13 via the resistors R19–R21, respectively.

A comparator CP1 is connected to the port 19 of the microprocessor via the resistors R22–R24 and a capacitor C1, and the output terminal of the comparator CP1 is connected to a horizontal oscillating terminal H-OSC for correcting the horizontal synchronization of the picture. A comparator CP2 is connected to the port 24 of the microprocessor via the resistors R25–R27 and a capacitor C2, and the output terminal of the comparator CP2 is connected to a vertical oscillating terminal V-OSC for correcting the vertical synchronization of the picture.

The port 36 is connected to a horizontal sync signal terminal H-SYNC for receiving the horizontal sync signal from a video card, and the port 27 is connected to a horizontal sync signal polarity terminal H-POL. The port 35 is connected to a vertical sync signal terminal H-SYNC, and the port 26 is connected to a vertical sync signal polarity terminal V-POL.

The picture-control mode terminals connected to the microprocessor ports may be modified as desired.

Figure 2:
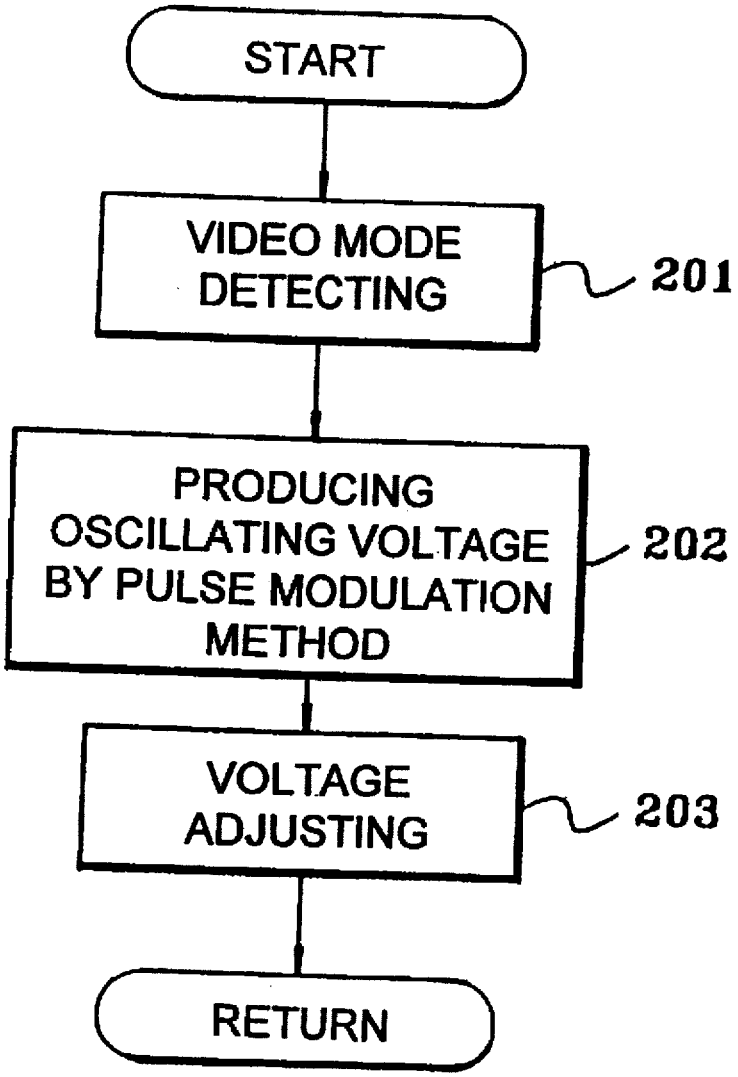
FIG. 2 is a main flowchart showing a monitor-mode control method according to the present invention.

FIG. 2 shows a main flowchart performed by the microprocessor, which includes step 201 of determining the video mode, step 202 of producing an oscillating voltage for maintaining the horizontal and vertical synchronization of the picture and step 203 of controlling a voltage by selecting a port connected to the picture-control mode terminal (side pin/barrel, horizontal size, vertical size, horizontal position, vertical position, etc.) in accordance with the determined video mode to vary the resistor.

Figure 3A:
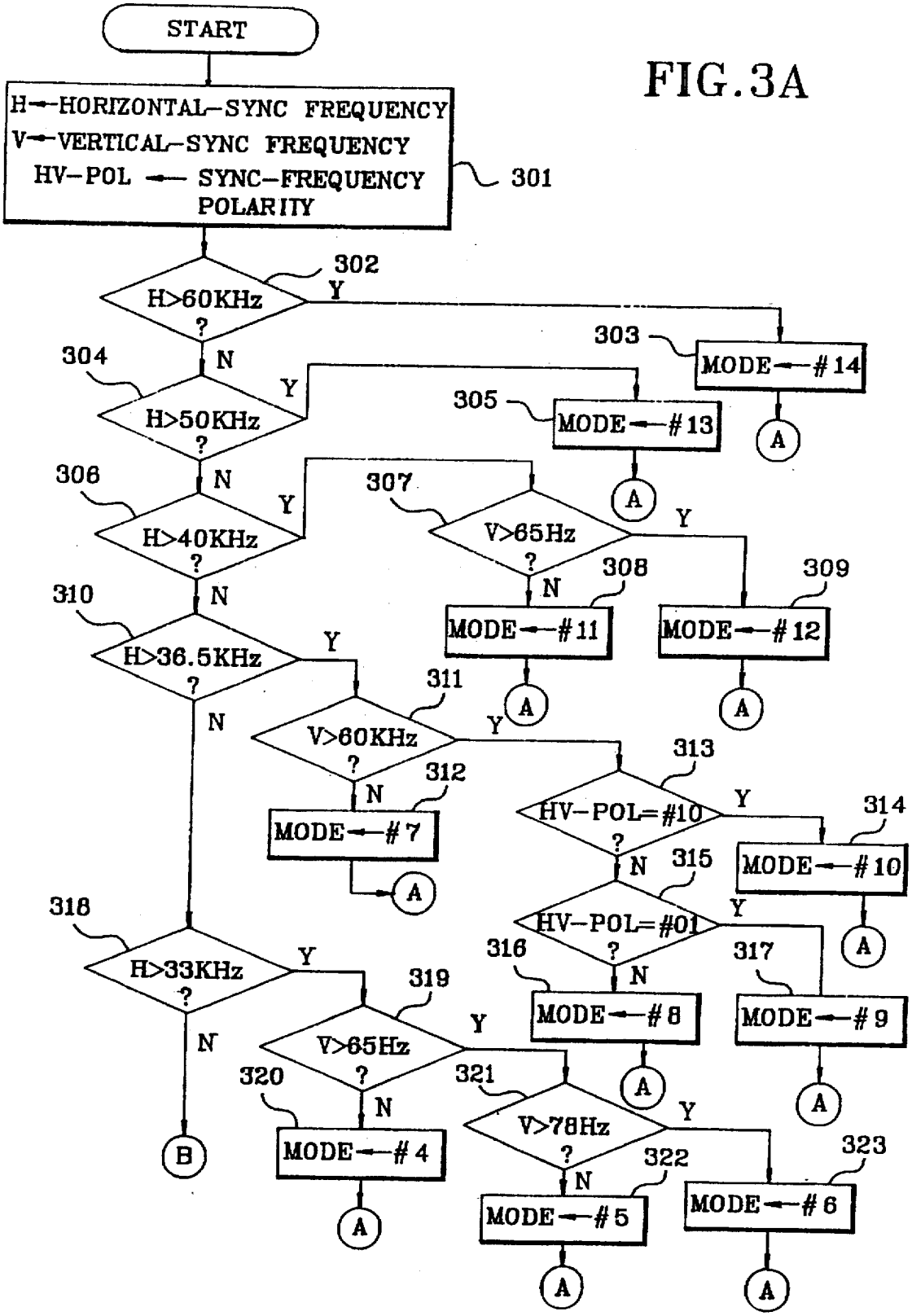
FIGS. 3A and 3B show a flowchart for determining the video mode of FIG. 2.
Figure 3B:
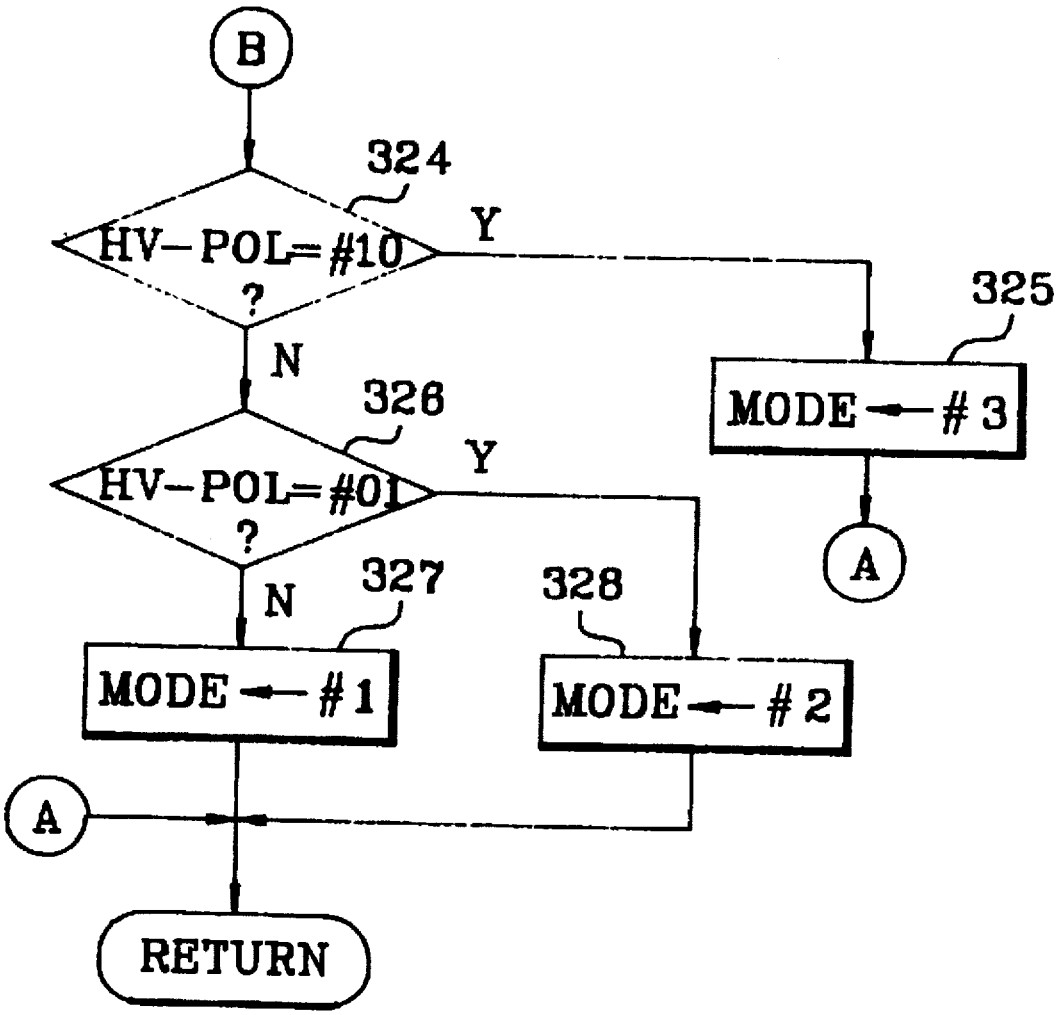

FIG. 3 shows a detailed flow chart of the step 201 for determining the video mode in FIG. 2.

Figure 4A:
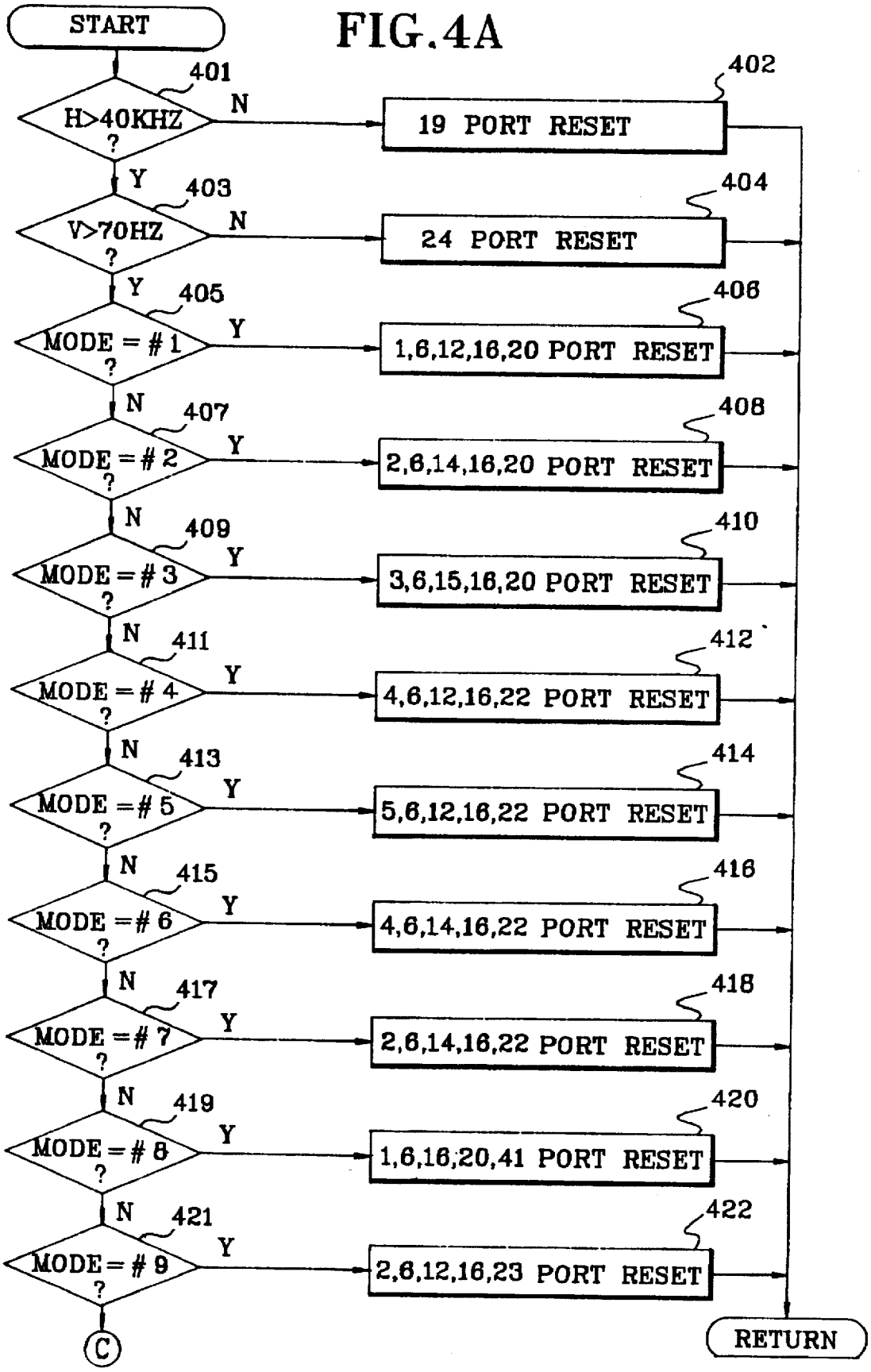
FIGS. 4A and 4B show a flowchart for controlling respective ports in accordance with the video mode determination result of FIG. 2.
Figure 4B:
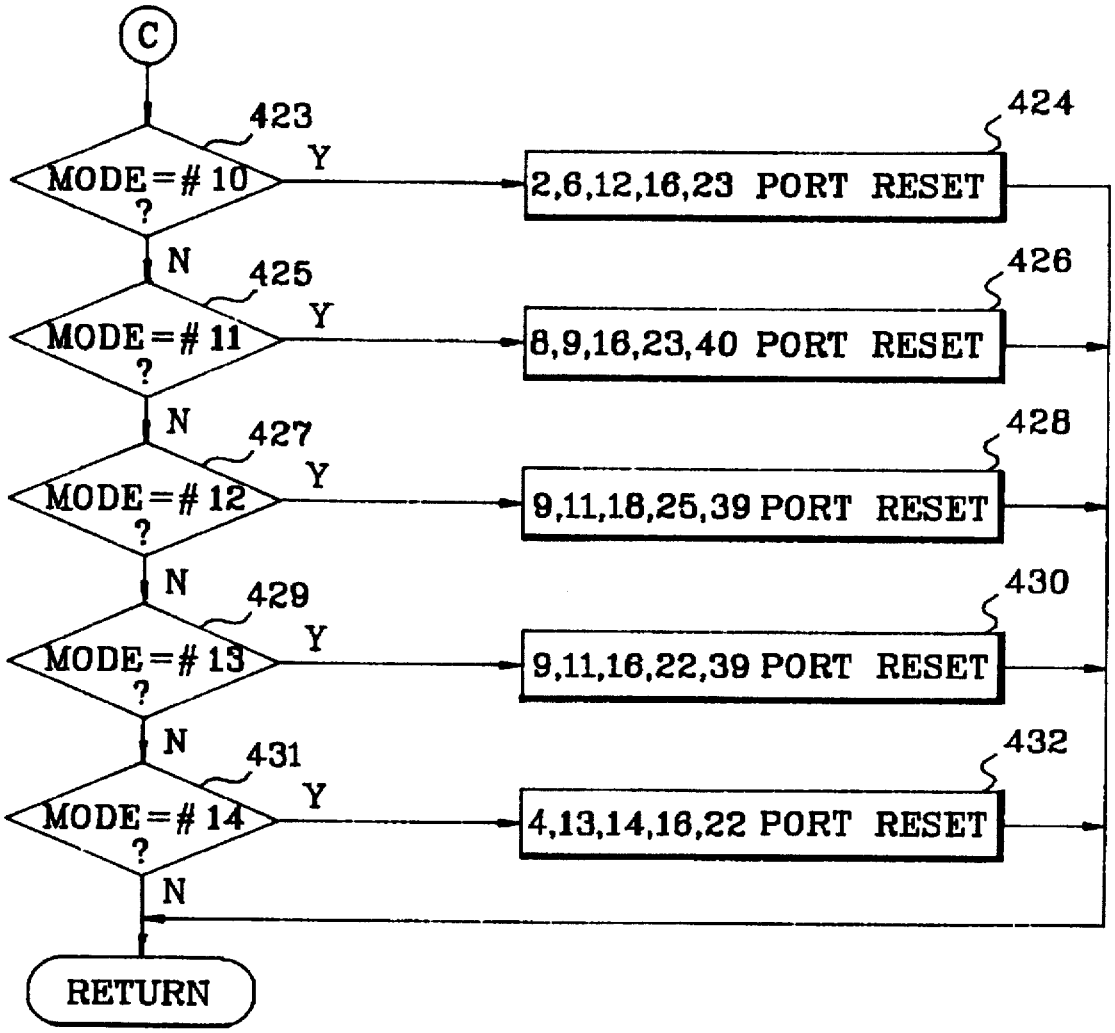

FIG. 4 shows a detailed flow chart of the step 202 for controlling the voltage by selecting the port connected to the picture-control mode terminal in accordance with the video mode determined in FIG. 2.

Here, FIGS. 3 and 4 may be changed by the demands of buyers.

In the circuit constructed as above, the horizontal sync frequency received from the video card is generally 30 kHz–100 kHz, and the vertical sync frequency is 40 Hz–120 Hz.

Once the power is turned on, all ports of the microprocessor are initiated to a high state. Then, horizontal and vertical sync frequencies and their polarities supplied to the ports 36, 27, 35 and 26 are determined (step 301).

At this time, in connection with the horizontal sync frequency, the horizontal frequency is counted by means of a counter depending upon a timer or counter interrupt signal of the microprocessor. That is, the horizontal sync signal received for a predetermined time (e.g., 100ms) is counted, and the horizontal sync frequency is calculated with the counted value and stored in a horizontal sync frequency storage variable H.

In connection with the vertical sync frequency, the vertical frequency is counted by means of the counter depending upon an external interrupt of the microprocessor. That is, the time from a predetermined falling edge to the next failing edge of the vertical sync frequency is counted, and the vertical frequency is calculated by the counted value and stored in a vertical sync frequency storage variable V.

The polarities of the horizontal and vertical sync frequencies are detected to be loaded on a polarity storage variable HV_POL of the horizontal and vertical sync frequencies.

Here, the polarities of the horizontal and vertical sync frequencies are classified into four catagories. In more detail, the storage variable HV_POL numbering 11 denotes that the polarities of both horizontal and vertical sync frequencies are positive, 10 denotes that the polarity of the horizontal sync frequency is positive and that of the vertical sync frequency is negative, and 01 denotes the reverse case of 10, and 00 denotes that the polarities of both horizontal and vertical sync frequencies are negative.

Thus, when the horizontal and vertical sync frequencies and polarities are detected in step 301, the video mode is determined through the step-flow of FIG. 3. The flow chart shown in FIG. 3 may be changed in view of the buyer's demand.

When the determined horizontal sync frequency H is determined to be higher than 60 kHz (step 302), the mode is determined as #14 and the mode 14 is stored in the mode variable (step 303).

In the same manner, when the horizontal sync frequency H is determined to be smaller than 60 kHz and greater than 50 kHz (step 304), the mode is determined as #13 and the mode 13 is stored in the mode variable (step 305).

When the horizontal sync frequency H is smaller than 40 kHz and greater than 36.5 kHz (step 310), it is determined whether the vertical sync frequency V is greater than 60 Hz (step 311).

If the vertical sync frequency V is determined to be smaller than 60 Hz in the step 311, the mode is determined as a mode #7 (step 312). Whereas, if the vertical sync frequency V is greater than 60 Hz, it is determined whether the horizontal and vertical sync frequency polarity HV_POL is 10 or not (step 313).

When the horizontal and vertical sync frequency polarity HV_POL is determined as 10 in the step 313, the mode #10 (step 314). Whereas, if it is not 10, the horizontal and vertical sync frequency polarity HV_POL is determined whether it is 01 or not (step 315).

If the horizontal and vertical frequency polarity HV_POL is determined to be 01 in the step 315, the mode is determined as a mode #9 (step 317) and if it is not 01, the mode is determined to he a mode #8 (step 316).

By carrying out the operation illustrated in FIG. 3, the video mode is determined in accordance with the horizontal and vertical sync frequencies H and V, and the horizontal and vertical sync frequency polarity HV_POL.

Therefore, after determining the video mode in accordance with the flow chart shown in FIG. 3, by performing the program shown in FIG. 4, horizontal and vertical oscillating frequency values corresponding to the horizontal and vertical sync frequencies are provided in such a manner that if the horizontal frequency is higher than 40 kHz, the port 19 is set while if it is lower, the port 19 is reset, and if the vertical frequency is higher than 70 kHz, the port 24 is set while it is lower, the port 24 is reset.

That is to say, if the voltage corresponding to the determined horizontal and vertical sync frequencies are output via the ports 19 and 24 by means of the PWM method, the horizontal and vertical oscillating voltages corresponding to the horizontal and vertical sync frequencies are output through the comparators CP1 and CP2 to correct the horizontal and vertical synchronizations of the picture. Here, if the synchronization is lagged, the image waves and is vibrated, so that accurate horizontal and vertical oscillating voltages must be output.

The above-described method in FIG. 3 in which the horizontal and vertical sync frequencies are divided into predetermined levels, and the level in accordance with the corresponding horizontal sync frequency is output via the port 19 to adjust the horizontal oscillating voltage is the PWM method.

Further, the program shown in FIG. 4 is executed to select, for respective modes, respective ports such as the vertical size V-SIZE, side pin/barrel, horizontal side H-SIZE, horizontal position H-POSI, vertical position V-CENTER to control the voltage.

In more detail, if the video mode is determined as the mode #1 (step 405) in FIG. 3, the ports 1, 6, 12, 16 and 20 of the microprocessor are reset to zero (step 406). At this time, since the other ports are in a high mode state, the voltage of the picture-control mode terminal (vertical size, side pin/barrel, horizontal size, horizontal position, and vertical position) becomes different.

Accordingly, the voltages of the vertical size V-SIZE, side pin/barrel, horizontal size H-SIZE, horizontal position H-POSI, and vertical position V-CENTER corresponding to the mode #1 are output. In the same manner, the ports 4, 6, 12, 16 and 22 are reset to zero (step 412), and the voltages of the vertical size V-SIZE, side pin/barrel, horizontal size H-SIZE, horizontal position H-POSI, and vertical position V-CENTER corresponding to the mode #4 are output.

When the video mode 9 in FIG. 3 is determined as the mode 9 #9 (step 317), the ports 2, 6, 12, 16 and 23 are reset to zero (step 421).

By performing the program shown in FIG. 4, the voltages of the horizontal and vertical oscillating frequencies, the vertical size V-SIZE, side pin/barrel, horizontal size H-SIZE, horizontal position H-POSI and vertical position V-CENTER corresponding to the determined video mode are output.

In other words, the resistance values respectively connected to the vertical size V-SIZE, side pin/barrel, horizontal size H-SIZE, horizontal position H-POSI and vertical position V-CENTER terminals become different to change the voltage of the picture-control mode in accordance with the video mode.

Where, the difference between the horizontal and vertical oscillating frequency output period, and the horizontal and vertical sizes, side pin/barrel, and the horizontal and vertical positions voltages output period may be several hundred seconds, and the outputs are not carried simultaneously, the sequence of the voltage outputs is negligible.

In the monitor-mode control circuit and method thereof according to the present invention, the flowcharts shown in FIGS. 3 and 4 may be extended by the demand of the buyer without changing the hardware, so that it is possible to easily correspond to any specification required by the buyer without limitation.

Furthermore, a predetermined port of a microprocessor is controlled to be high or low for varying an external resistance value connected to the predetermined port, so that the voltage of a picture-control mode such as the horizontal size, vertical size, horizontal position, vertical position, side pin/barrel, etc., suitable for a determined video mode is varied, and the voltage of an oscillating frequency for correcting the synchronization of the picture is output through a PWM method to economize manufacturing costs without using a D/A converter and the EEPROM, thereby increasing the competitive power of the products.

While the present invention has been particularly shown and described with reference to particular embodiments thereof, it will be understood by those skilled in the art that various changes in form and details may be effected therein without departing from the spirit and scope of the invention as defined by the appended claims.

What is claimed is:

1. A monitor-control method comprising the steps of:

detecting horizontal and vertical sync frequencies and polarities of horizontal and vertical sync signals input from a video card;

determining, in a microprocessor, a video mode of said video card, using the detected horizontal and vertical sync frequencies and polarities;

producing an oscillating voltage in accordance with corresponding horizontal and vertical sync frequencies by pulse width modulation in which said horizontal and vertical sync frequencies are divided into predetermined levels;

outputting a high or low signal, simultaneously while outputting said oscillating voltage, by selecting a respective one of a plurality of ports of a picture control terminal of said microprocessor in accordance with the determined video mode, thereby adjusting a voltage of a signal supplied to said picture control terminal, and connecting resistors to said ports in parallel to each said picture control terminal associated with a respective plurality of said ports to adjust said voltage supplied to each said picture control terminal depending on the selected one of said ports associated therewith and its associated resistor.

* * * * *